United States Patent [19]

Pringle

[11] 4,252,197

[45] Feb. 24, 1981

[54] PISTON ACTUATED WELL SAFETY VALVE

[75] Inventor: Ronald E. Pringle, Houston, Tex.

[73] Assignee: Camco, Incorporated, Houston, Tex.

[21] Appl. No.: 27,207

[22] Filed: Apr. 5, 1979

Related U.S. Application Data

[63] Continuation-in-part of Ser. No. 881,484, Feb. 27, 1978, Pat. No. 4,161,219.

[51] Int. Cl.[3] ..... E21B 34/10

[52] U.S. Cl. ..... 166/322; 166/324; 166/72; 251/62

[58] Field of Search ..... 257/62; 166/321, 324, 166/322, 72

[56] References Cited

U.S. PATENT DOCUMENTS

| | | | |
|---|---|---|---|
| 3,782,461 | 1/1974 | Watkins | 166/72 |
| 3,897,825 | 8/1975 | Tausch | 166/321 |
| 4,161,219 | 7/1979 | Pringle | 166/324 |

*Primary Examiner*—William F. Pate, III

*Attorney, Agent, or Firm*—Fulbright & Jaworski

[57] ABSTRACT

In a well safety valve for controlling the fluid flow through a well conduit in which the valve has a housing and a tubular member controlling a valve element the improvement in means for opening and closing the valve. At least one piston is telescopically movable within and has its longitudinal axis within the wall of the housing and outside of the tubular member and engages the tubular member. The first side of the piston is in communication with a hydraulic passageway adapted to extend to the well surface for opening the valve. The second side of the piston extends into a closed gas chamber tending to move the valve to the closed position. The piston has a small cross-sectional area for reducing the pressure effect in the gas chamber of the gas caused by movement of the second side of the piston whereby the differential between the opening and closing forces are reduced thereby allowing the valve to be used at greater depths in the well. Preferably, valve means is positioned in the piston for charging the gas chamber. In one embodiment the gas chamber and the hydraulic passageway are positioned out of communication with the tubular member thereby eliminating the need for seals on the tubular member for enclosing portions of the gas chamber or hydraulic passageway. In another embodiment the valve closure member is positioned between the first and second sides of the piston allowing the use of a shorter tubular member providing a shorter safety valve.

6 Claims, 6 Drawing Figures

26a
64
12a
30a
22a
41a
62
34a 70
10b
26b
22b
12b
30b
38b
72
16
5
5
18
34b

PISTON ACTUATED WELL SAFETY VALVE

CROSS-REFERENCE TO RELATED APPLICATION

This application is a continuation-in-part of patent application Ser. No. 881,484, filed Feb. 27, 1978 for Piston Actuated Well Safety Valve, now U.S. Pat. No. 4,161,219.

BACKGROUND OF THE INVENTION

Generally, it is old to provide a subsurface well safety valve for use in a well for shutting off flow of well fluids through the well tubing. U.S. Pat. No. 3,782,461 discloses a safety valve in which the valve is opened by a piston in response to hydraulic fluid applied from the well surface and is biased to a closed position by suitable means including a pressurized gas chamber acting on the piston. Generally, the means biasing the valve to a closed position must overcome the hydrostatic head in the hydraulic control line to the piston as well as providing a closing force. Because the hydrostatic forces increase with depth, the gas in the chamber must be increasingly pressurized in order to utilize the safety valve at greater depths. However, there are limits to which the pressure in the gas chamber in a safety valve may be increased. Furthermore, when a conventional piston actuated safety valve is open, the piston acts against the biasing gas in the pressurized chamber to further increase the pressure in the gas chamber. Thus, there is a differential in the pressure in the gas chamber or "spread" between opening and closing pressures which limits the closing pressure that can be applied to a safety valve and in turn limits the depth at which the safety valve can be set without exceeding the pressure limitations in the gas chamber. For example, the differential or spread between the opening and closing pressure in a typical safety valve such as shown in U.S. Pat. No. 3,782,461 may be 1500 psi. If the differential pressure or spread is reduced, such as to 100 pounds or less, the safety valve may be utilized with a higher closing pressure and thus set at greater depths.

The present invention is directed to various improvements in a piston actuated subsurface well safety valve which is biased to a closed position by a pressurized gas chamber in which a structure is provided that reduces the cross-sectional area of the piston which in turn reduces the pressure buildup in the gas chamber when the valve is opened thereby reducing the differential between the opening and closing forces to allow the valve to be set at greater depths as well as reducing undesired seal areas in the valve.

SUMMARY

The present invention is directed to a subsurface well safety valve which is opened by a piston hydraulically actuated from the well surface and which is biased to a closed position by a pressure charged gas chamber in which the longitudinal axis of the piston is within the wall of the housing and outside of the tubular member and has a cross-sectional width less than the thickness of the housing. This allows the cross-sectional area in the diameter of the piston to be small thereby (1) reducing the area on which the biasing gas acts so that the differential between the opening and closing forces is reduced thereby allowing the valve to be used at a greater depth in the well, (2) decreases the cost of manufacture, (3) increases the ease of manufacture, and (4) moves the piston seals to a more remote location from the well fluid, Another object of the present invention is the provision of valve means in the piston for charging the gas chamber.

Still a further object of the present invention is the provision of providing a gas chamber which is out of communication with the tubular member thereby eliminating the need for seals on the tubular member for enclosing a portion of the gas chamber.

Still a further object of the present invention is the provision of positioning the hydraulic passageway out of communication with the tubular member thereby eliminating the need for seals on the tubular member for enclosing a portion of the hydraulic passageway.

Yet a still further object is the provision of positioning the valve closure member between the ends of the piston thereby allowing the use of a shorter tubular member to provide a shorter safety valve.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

While the present improvements in a subsurface well safety valve will be shown, for purposes of illustration only, as incorporated in a flapper-type saftey valve, it will be understood that the present invention may be used with other types of safety valves, such as either tubing retrievable or wireline retrievable, and safety valves having various other types of valve closing elements.

Figure 1A:
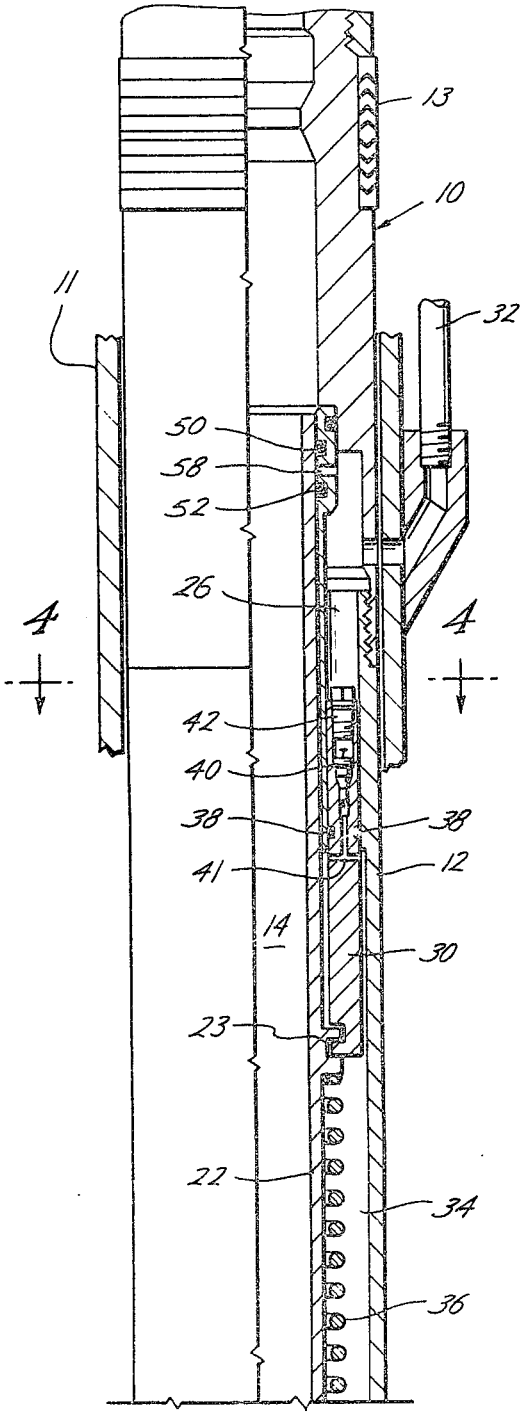
FIGS. 1A and 1B are continuations of each other of a fragmentary elevational view, partly in cross section, of a well safety valve utilizing one form of the present invention and shown in the open position.
Figure 1B:
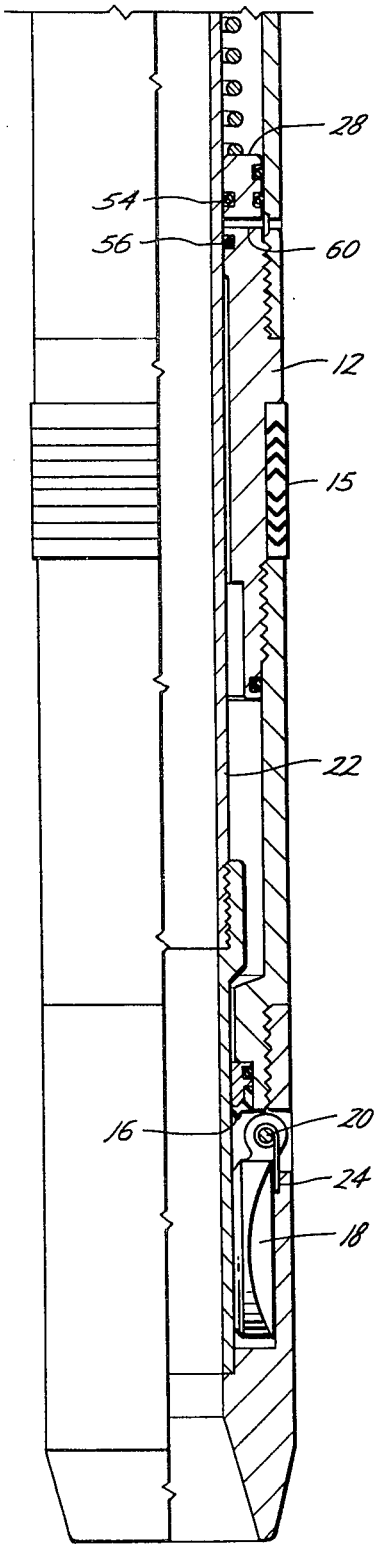
Figure 4:
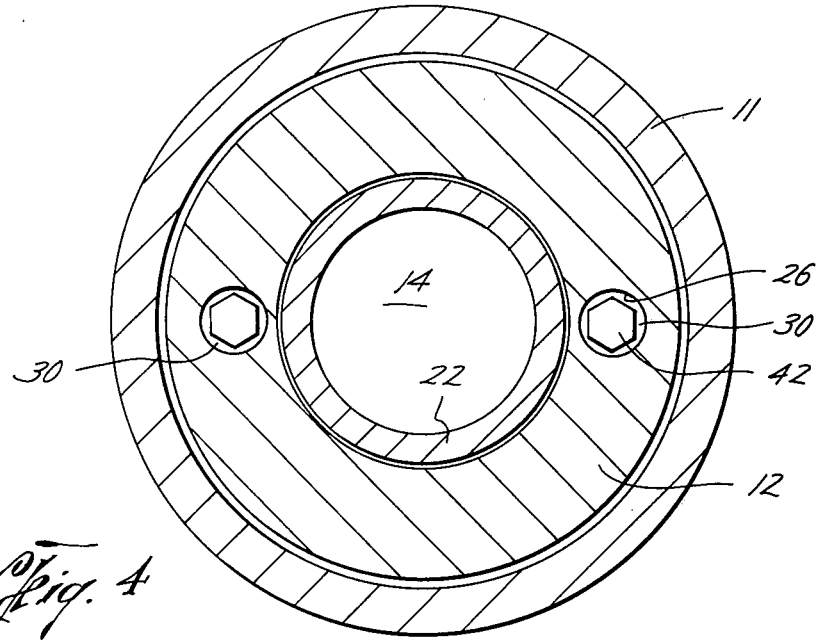
FIG. 4 is a cross-sectional view taken along the line 4—4 of FIG. 1A.

Referring now to the drawings, and particularly to FIGS. 1A, 1B and 4, the subsurface safety valve of the present invention is generally indicated by the reference numeral 10 and is shown as being of a retrievable type for connection in a well conduit or well tubing 11 by a conventional lock (not shown). The safety valve 10 generally includes a housing 12 adapted to be positioned in the tubing 11 and sealed against the tubing 11 by suitable seals 13 and 15 and to permit well production through the valve 10 under normal operating conditions, but in which the safety valve 10 may close or be closed in response to abnormal conditions such as might occur when the well over produces, blows wild, or in the event of failure of well equipment.

The safety valve 10 generally includes a bore 14, an annular valve seat 16 positioned about the bore 14, a valve closure element such as a flapper valve 18 connected to the housing 12 by a pivot pin 20. Thus, when the flapper 18 is in the upper position and seated on the valve seat 16, the safety valve 10 is closed, blocking flow upwardly through the bore 14 and the well tubing 11. A sliding tube or tubular member 22 is telescopically movable in the housing 12 and through the valve seat 16. As best seen in FIG. 1B, when the tubular member 22 is moved to a downward position, the tube 22 pushes the flapper 18 away from the valve seat 16. Thus, the valve 10 is held in the open position so long as the sliding tube 22 is in the downward position. When the sliding tube 22 is moved upwardly, the flapper 18 is allowed to move upwardly onto the seat 18 by the action of a spring 24 and also by the action of the fluid flow moving upwardly through the bore 14 of the housing 12.

The safety valve 10 is controlled by the application or removal of hydraulic fluid, such as though a control line 32 connected to the tubing 11 or through the casing annulus (not shown) which supplies a hydraulic fluid to a hydraulic passageway 26 in the housing 10 and to the first side or top of one or more pistons 30 which in turn engage the tubular member 22 such as by a tongue and groove connection 23 to move the tubular member 22 downwardly forcing the flapper 18 off of the seat 16 and into the full open position. Biasing means, such as a pressure charged gas chamber 34 and a spring 36, if desired, may act between a shoulder 28 on the valve housing 12 and against the second or lower end of the piston 30 for yieldably urging the tubular member 22 in an upward direction to release the flapper 18 for closing the valve 10. If the fluid pressure in the line 32 is reduced sufficiently relative to the biasing forces urging the tubular member 22 upwardly, the tubular member 22 will move upwardly allowing the flapper 18 to close on the valve seat 16.

However, it is to be noted that the safety valve 10 will be positioned downhole in a well and the control line 32 and hydraulic passageway 26 will be filled with a hydraulic fluid which exerts a downward hydrostatic force on the pistons 30 in the valve 10 at all times regardless of whether control pressure is exerted on or removed from the control line 32. This means that the upwardly biasing means such as the gas pressure in the pressure charged gas chamber 34 and the spring 36 if used, must be sufficient to overcome the hydrostatic pressure forces existing in the control line 32 as well as provide a closure force to move the tubular member 22 upwardly. However, there is a limit to the biasing pressure that can be maintained in the gas chamber 34 which in turn limits the depth at which the safety valve 10 may be placed in the well. Some present forms of hydraulically actuated piston well safety valves having pressurized gas chamber biasing means, such as shown in U.S. Pat. No. 3,782,461, utilize a large annular piston connected to and positioned about the tubular member 22. However, when the valve 10 is moved to the open position, the piston will move into the gas chamber 34 increasing the pressure in the gas chamber. The differential pressures between the opening and closing forces must be taken into consideration in determining the maximum upper charged limit which may be created in the chamber 34. That is, the differential pressure forces or "spread" must be subtracted from the maximum limit which can be applied in the chamber 34 to determine the maximum setting pressure that can be applied to the valve 10 and thus the maximum depth on which the valve 10 can be set. Therefore, a large differential pressure between opening and closing will reduce the depth at which the valve may be operable.

The present invention is directed to a piston actuated well safety valve 10 having a pressure charged chamber 34 in which the piston provides a small piston area exposed to the pressurized gas in the chamber 34 which reduces the differential pressure or "spread" between the opening and closing forces thereby allowing the valve 10 to be used at greater depths in the well. In addition, a smaller diameter cross-sectional area piston provides manufacturing and operating advantages and reduces seal drag.

The present invention is directed to providing one or more pistons 30 which are telescopically movable in the housing 12 and which have a small cross-sectional area for reducing the pressure increase in the gas chamber 34 as the pistons 30 move from the closed to the open position whereby the differential between the opening and closing pressures are reduced allowing the valve to be used at greater depths in the well. The longitudinal axis of the pistons 30 are eccentric to or offset from the longitudinal axis of the passageway 14 and housing 12 and are enclosed within the wall of the housing 12 and outside of the tubular member 22. In addition, the pistons 30 have a cross-sectional width less than the thickness of the housing 12. Furthermore, the offset pistons 30 allow the use of a piston of smaller diameter and cross-sectional area which reduces seal drag, allows better control of the piston size since tolerances are not a great factor, and reduces the cost and complexity of manufacture. For comparison, a conventional 2½ inch safety valve has a cross-sectional piston area of about 1.300 square inches, while the combined cross-sectional area of the two pistons 30 shown in FIGS. 1A and 1B may be 0.153 square inches. Since the extent of travel of the tubular member 22 will be the same in a conventional safety valve as in the present safety valve, it will be noted that the pressure differential or spread in the present invention may be as low as 50 psi while the pressure or spread in a conventional valve of the same size is about 1000 psi. This allows the present improved safety valve 10 to set its closing pressure higher and thus to be utilized at a greater depth than a conventional valve since the pistons 30 displace less of the gas in the pressurized chamber 24 than a conventional large annular piston. Also in view of the lower spread achieved in the present valve, lower surface operating pressures may be obtained.

The pistons 30 move in the hydraulic passageways 26 and are sealed therein by means of suitable seals 38 with their lower ends extending into the gas chamber 34. Advantageously, the gas chamber 34 may be suitably charged by providing valve means such as a dill valve 40 and charging path 41 in one of the pistons 30 and, after charging, sealing off the valve 40 by a sealing bolt 42.

Various embodiments of the foregoing hydraulically actuated piston safety valve which is biased by a pressurized gas chamber may be provided and are hereinafter described in FIG. 2 and additionally in FIG. 3 wherein like parts are similarly numbered with the addition of the suffix "a" and "b", respectively.

It is to be noted in referring to FIGS. 1A and 1B that the tubular member 22 telescopically moves within large diameter upper seals 50 and 52 and lower seals 54 and 56 in order to enclose the gas chamber 34. Furthermore, fluid passageways 58 and 60 are provided to insure that in the event of failure from any of the seals, high pressure will enter the chamber 34 to insure that the valve fails in a closed position.

Figure 2:
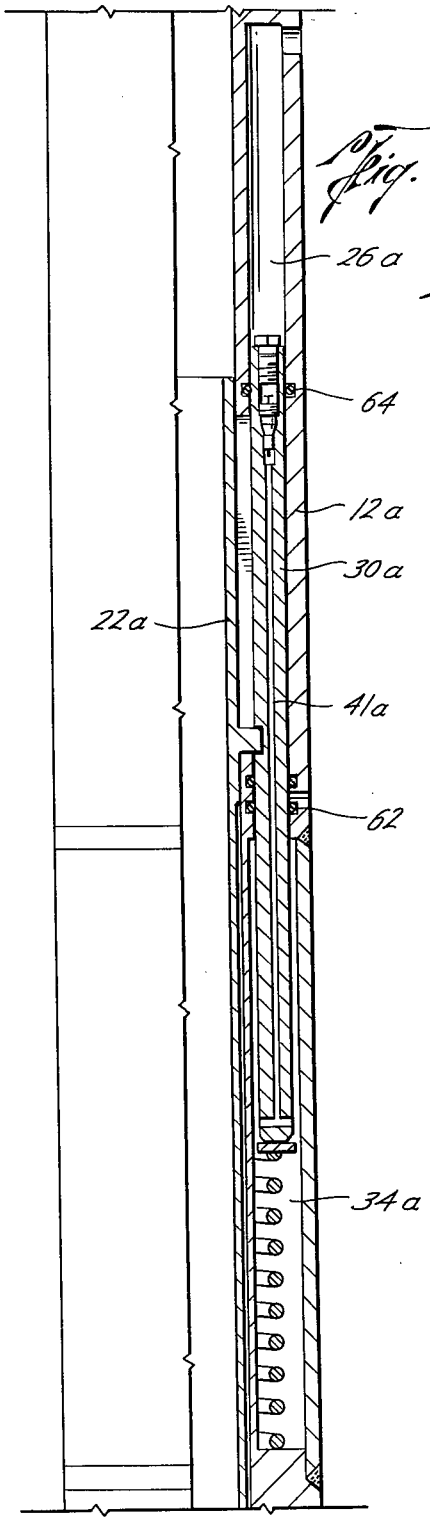
FIG. 2 is a fragmentary elevational view, partly in cross section, of another embodiment of the present invention showing improved means for opening and closing the safety valve.

Referring now to FIG. 2, a further embodiment of means for moving the tubular member 22*a* to open and closed positions is best seen. In this embodiment, the enclosed gas chamber 34*a* is out of communication with the tubular member 22*a* and the hydraulic passageway 26*a* is out of communication with the tubular member 22*a* thereby eliminating the large seals about the tubular member 22*a*. Thus, as shown, the tubular member 22*a* requires no seals, the gas chamber 34 is enclosed and the pressurized gas therein is exposed only to the small diameter seal 62 thereby further increasing the capacity of the chamber 34*a* for increased gas pressures and still greater depths. Without seals contacting the tubular member 22*a*, the member 22*a* is subjected to less drag and is easier to move. The pistons 30*a* are also slideable through the lower seal 62 into the gas chamber 34*a* and through upper seals 64 into the hydraulic passageway 26*a*.

Figure 3:
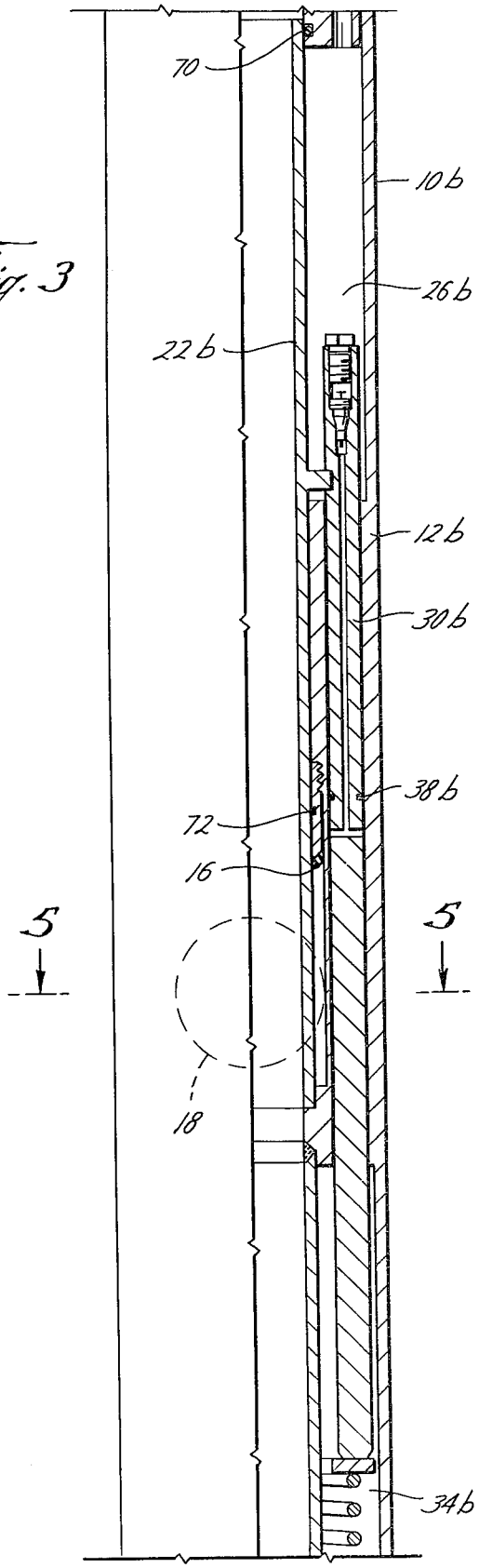
FIG. 3 is a fragmentary elevational view, partly in cross section, of a further embodiment of the present invention illustrating other means for opening and closing a safety valve.
Figure 5:
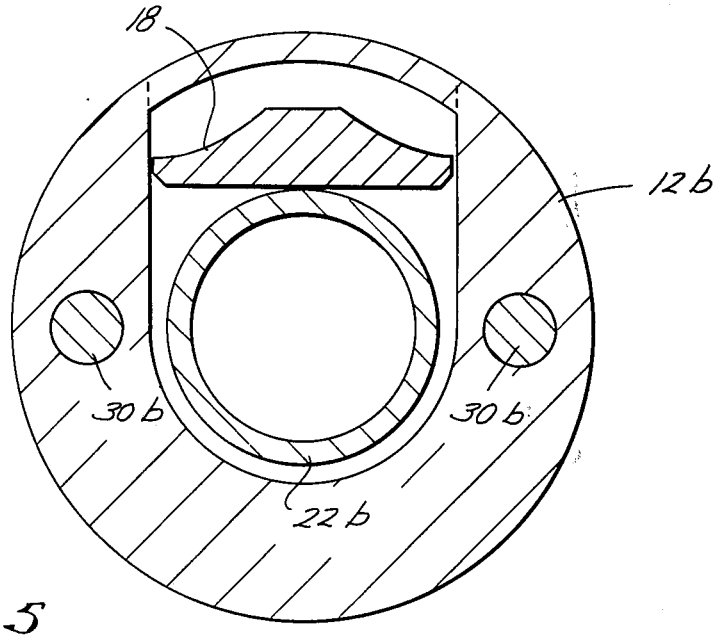
FIG. 5 is a cross-sectional view taken along the line 5—5 of FIG. 3.

Referring now to FIGS. 3 and 5, a further embodiment of a hydraulic actuated piston 30*b* telescopically movable in a hydraulic passageway 26*b* and a closed pressurized gas chamber 34*b* for actuating a tubular member 22*b* is best seen. In this embodiment, the valve element or flapper 18 is disposed between the upper and lower ends of the piston 30*b* thereby shortening the longitudinal length of the tubular member 22*b* which in turn shortens the longitudinal length of the safety valve 10*b* which is desirable in many applications. In this embodiment, the enclosed metal gas chamber 34*b* is out of communication with the tubular member 22*b* and the gas therein is subjected only to the small seal 38*b* on the piston 30*b*, thereby allowing the use of higher pressures in the chamber 34*b*. The tubular member 22*b* is engaged by seals 70 and 72 to enclose a portion of the hydraulic passageway 26*b*. However, in this embodiment no fail-safe passageways are needed as the gas in the pressurized chamer 34*b* is exposed to the high pressure fluid in passageway 26*b* on the second side of its only seal 38*b*.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In a well safety valve for controlling the fluid flow through a well conduit and including a tubular housing and a valve closure member moving between open and closed positions, a longitudinally tubular member telescopically movable in the housing for controlling the movement of the valve closure member, the improvement in means for moving the tubular member in a first direction for causing the valve closure member to move to the closed position and means for moving the tubular member in a second direction for opening the valve closure member comprising, at least one piston telescopically movable within and having its longitudinal axis within the wall of the housing and outside of the tubular member, said piston engaging said tubular member, the first side of the piston being in communication with a hydraulic passageway adapted to extend to the well surface for actuating said tubular member in the second direction to open said valve closure member, a closed gas chamber in the housing, the second side of the piston extending into the chamber and being exposed to the gas pressure in the chamber tending to move the piston in the first direction, said piston having a cross-sectional width less than the thickness of the housing for reducing the pressure effect in the gas chamber of the gas exposed to the second side of the piston whereby the differential between the opening and closing forces are reduced.

2. The apparatus of claim 1 including, valve means in the piston for charging the gas chamber.

3. The apparatus of claim 1 wherein the gas chamber is out of communication with the tubular member thereby eliminating the need for seals on the tubular member for enclosing a portion of the gas chamber.

4. The apparatus of claim 1 or 3 wherein the hydraulic passageway is out of communication with the tubular member thereby eliminating the need for seals on the tubular member for enclosing a portion of the hydraulic passageway.

5. The apparatus of claim 1 wherein the valve closure member is vertically positioned in the housing below the first side and above the second side of the piston thereby allowing the use of a shorter tubular member providing a shorter safety valve.

6. The apparatus of claim 1 wherein the gas chamber is a metal enclosed chamber exposed only to seal means on the piston.

* * * * *